US006401960B1

(12) United States Patent
Hammett

(10) Patent No.: US 6,401,960 B1
(45) Date of Patent: Jun. 11, 2002

(54) TWO LITER BOTTLE CRATE

(75) Inventor: Roy Hammett, Odessa, FL (US)

(73) Assignee: Norseman Plastics Limited, Ontario (CA)

( * ) Notice: Subject to any disclaimer, the term of this patent is extended or adjusted under 35 U.S.C. 154(b) by 0 days.

(21) Appl. No.: 09/893,542

(22) Filed: Jun. 29, 2001

(51) Int. Cl.[7] ..... B65D 71/00
(52) U.S. Cl. ..... 220/516; 220/519; 206/203
(58) Field of Search ..... 220/516, 517, 220/518, 519; 206/203

(56) References Cited

U.S. PATENT DOCUMENTS

| | | | | |
|---|---|---|---|---|
| 2,743,030 A | | 4/1956 | Read, Jr. | |
| 2,970,715 A | * | 2/1961 | Kappel et al. | 220/516 |
| 3,326,410 A | | 6/1967 | Asenbauer | |
| 3,333,727 A | * | 8/1967 | Belcher et al. | 220/519 X |
| 3,349,943 A | | 10/1967 | Box | |
| 3,376,998 A | * | 4/1968 | Cornelius | 220/516 X |
| 3,628,684 A | * | 12/1971 | Sere | 220/519 X |
| 3,812,996 A | | 5/1974 | Bunnell | |
| 4,101,049 A | | 7/1978 | Wallace et al. | |
| 4,162,738 A | * | 7/1979 | Wright | 220/519 |
| 4,204,596 A | | 5/1980 | Davis | |
| 4,319,685 A | | 3/1982 | David | |
| D275,142 S | | 8/1984 | Torokvei | |
| 4,538,742 A | * | 9/1985 | Prodel | 220/518 X |
| 4,588,087 A | * | 5/1986 | Swingley, Jr. | 220/519 X |
| D284,841 S | | 7/1986 | Rowland et al. | |
| D289,938 S | | 5/1987 | Warwick | |
| 4,700,836 A | | 10/1987 | Hammett | |
| 4,700,837 A | | 10/1987 | Hammett | |
| 4,773,554 A | | 9/1988 | Warwick | |
| 4,789,060 A | | 12/1988 | Hammett | |
| D304,123 S | | 10/1989 | Warwick | |
| 4,899,874 A | | 2/1990 | Apps et al. | |
| 4,928,841 A | | 5/1990 | Arthurs | |
| 4,932,532 A | | 6/1990 | Apps et al. | |
| 4,944,400 A | | 7/1990 | Van Onstein et al. | |

(List continued on next page.)

FOREIGN PATENT DOCUMENTS

| | | |
|---|---|---|
| AU | 247904 | 8/1962 |
| GB | 1032916 | 6/1966 |

*Primary Examiner*—Steven Pollard
(74) *Attorney, Agent, or Firm*—Nixon & Vanderhye P.C.

(57) ABSTRACT

A low depth bottle crate includes a peripheral wall of uniform height, the peripheral wall including a pair of side walls and a pair of end walls. A longitudinal interior partition extends between the end walls and a plurality of transverse interior partitions extend between the side walls to thereby create a plurality of bottle receiving pockets within the peripheral wall. A crate bottom is connected to the peripheral wall, an upper surface of the crate bottom formed to include a bottle supporting platform for each of the bottle receiving pockets. A plurality of interior columns are located at intersections of the transverse partitions and the longitudinal partition, each interior column having an interior surface facing radially into each of four of the bottle receiving pockets that surround each of the interior columns, the surface having a pair of vertically extending interior convex ribs adapted to provide support for a bottle loaded into the respective pocket. Similar half columns are located about the side walls and similar quarter columns are located in the crate corners. Thus, the surfaces that support the peripheral surface of the bottles located in the bottle receiving pockets are all in the form of vertically oriented convex ribs. The underside of the crate bottom is provided with a unique array of mutually perpendicular bottle closure receiving recesses, centered on the respective bottle supporting platforms.

53 Claims, 7 Drawing Sheets

U.S. PATENT DOCUMENTS

| | | | | | |
|---|---|---|---|---|---|
| 4,978,002 | A | | 12/1990 | Apps et al. | |
| 5,031,761 | A | * | 7/1991 | de Larosiere | 206/203 |
| D319,129 | S | | 8/1991 | Apps et al. | |
| 5,060,819 | A | | 10/1991 | Apps | |
| D327,357 | S | | 6/1992 | Rehrig | |
| D327,972 | S | | 7/1992 | Apps et al. | |
| 5,426,890 | A | | 6/1995 | Dümmen | |
| 5,465,843 | A | | 11/1995 | Koefelda | |
| 5,487,487 | A | | 1/1996 | Apps et al. | |
| 5,501,352 | A | | 3/1996 | Apps | |
| 5,529,176 | A | | 6/1996 | Apps et al. | |
| D378,249 | S | | 3/1997 | Apps et al. | |
| D379,717 | S | | 6/1997 | Apps et al. | |
| D380,613 | S | | 7/1997 | Apps et al. | |
| D380,901 | S | | 7/1997 | Apps et al. | |
| 5,651,461 | A | * | 7/1997 | Apps et al. | 220/519 X |
| 5,660,279 | A | | 8/1997 | Apps et al. | |
| D395,954 | S | | 7/1998 | Apps et al. | |
| 5,823,376 | A | | 10/1998 | McGrath | |
| 5,855,277 | A | | 1/1999 | Apps et al. | |
| 6,131,730 | A | | 10/2000 | Hsu | |
| 6,237,758 | B1 | | 5/2001 | Hsu | |

* cited by examiner

TWO LITER BOTTLE CRATE

This invention relates to crate constructions for bottles and more specifically, to a low depth crate for standard petaloid two-liter bottles.

BACKGROUND OF THE INVENTION

Low depth bottle crates are well known in the art as exemplified by U.S. Pat. Nos. 4,700,836; 4,928,841; 5,060,819; and 5,855,277. These crates typically have side and end walls that extend only about one-third the height of standard two-liter bottles. This means that, when loaded and stacked, crates rest directly on the bottles in an underlying crate. The low depth of the crate is attractive, however, since it reduces material costs, enhances visibility of the bottles, and reduces shipping space when stacked empty. Some prior crates employ crate height increasing features to provide greater support for bottles received therein, while still permitting the bottle labels to be seen. Such features may include columns that extend above the side and end walls of the crate as exemplified in U.S. Pat. Nos. 4,899,874; 4,978,002; and 5,501,352.

Low depth crates also typically have concave bottle supporting surfaces that generally conform to the shape of the bottle. The concave surfaces provide good bottle support but may result in undesirable scuffing of the bottle surface, however, particularly if dirt, sand or other debris becomes trapped between the bottle surface and the concave crate surfaces.

BRIEF SUMMARY OF THE INVENTION

The crate of this invention includes a peripheral wall of uniform height with radiused cut-outs spaced along the side walls and end walls of the crate. In the areas between the cut-outs and in the corners, thickened pads are formed on the exterior of the peripheral wall to provide additional surface area for palletizing equipment and the like, and to provide better side-to-side support when similar crates are stacked in adjacent columns.

The interior of the crate is divided by a longitudinal center partition and three transverse partitions that together define a plurality of bottle receiving pockets, arranged in two longitudinal rows, each with four pockets. Interior bottle support columns are located along the longitudinal partition where it intersects with the transverse partitions, and thus, in the exemplary embodiment, there are three such interior columns, one of which is located at the longitudinal and transverse center of the crate. Similar partial, or "half columns" are located along the side walls where the transverse partitions intersect the side walls, and centrally of the end walls, while "quarter columns" are provided in the corners of the crate. Each of the various column structures is formed to include a pair of vertically oriented convex ribs facing radially into each adjacent pocket. Thus, the interior columns are provided with a pair of such ribs for each of four surrounding pockets; the side and end wall half columns are provided with a pair of such ribs for each of two adjacent pockets; and the corner quarter columns are provided with a pair of such ribs for each respective corner pocket.

The various columns are substantially hollow and are formed with relatively large cut-out portions in the lower halves thereof to reduce weight and to facilitate nesting of similar empty crates.

The end walls of the crate are also formed with cut-outs in the lower portions thereof to create handle openings at opposite ends of the crate.

The crate bottom is formed with bottle support platforms for respective bottle receiving pockets, each support platform having a raised center area adapted to project upwardly into a recess formed in the bottom of a conventional petaloid type 2-liter bottle. The underside of the crate bottom is formed with elongated recesses located centrally of the bottle support platforms, with the recesses under the four center pockets (those pockets surrounding the interior column at the center of the crate) arranged in one direction and the recesses in the transverse pair of pockets at each end of the crate arranged in a mutually perpendicular direction. When similar loaded crates are stacked, bottle closures or caps of bottles in the underlying crate will be received in the elongated recesses, and the cooperation between the mutually perpendicular recesses tends to substantially center the closures within the recesses.

Within certain of the partial columns along the side walls of the crate, nesting ribs are provided that are engaged by the top surfaces of an underlying crate when similar empty crates are stacked.

Another feature of the invention relates to an instability projection, optionally added to the top of an interior column to discourage users from inverting the crate and using it as a step stool.

Accordingly, in one aspect, the present invention relates to a low depth bottle crate having a peripheral wall of uniform height, the peripheral wall including a pair of side walls and a pair of end walls; a longitudinal interior partition extending between the end walls and a plurality of transverse interior partitions extending between the side walls to thereby create a plurality of bottle receiving pockets within the peripheral wall; a crate bottom connected to the peripheral wall, an upper surface of the crate bottom formed to include a bottle supporting platform for the bottle receiving pocket; a plurality of interior columns located at intersections of the transverse partitions and the longitudinal partition, each interior column having an interior surface facing radially into each of four of the bottle receiving pockets that surround each of the interior columns, the surface having a pair of vertically extending interior convex ribs adapted to provide support for a bottle loaded into the respective pocket.

In another aspect, the invention relates to a bottle crate having a peripheral wall including a pair of side walls and a pair of end walls; a crate bottom integrally connected to the peripheral wall, an upper surface of the crate bottom formed to include a plurality of bottle supporting platforms, each platform having an aperture centered on a vertical center axis of the platform; each platform having a lower surface formed with an elongated recess extending across the vertical axis, the elongated recess having a flat base surrounded by a tapered surface, the flat base defined by a pair of straight parallel sides with radiused curves at opposite ends thereof.

In another aspect, the invention relates to a bottle crate having a peripheral wall including a pair of side walls and a pair of end walls; a crate bottom integrally connected to the peripheral wall, an upper surface of the crate bottom formed to include a plurality of bottle supporting platforms, each platform having a vertical center axis; each platform having a lower surface formed with an elongated recess extending across the vertical axis; wherein some of the recesses extend parallel to the side walls and some of the recesses extend parallel to the end walls.

In another aspect, the invention relates to a low depth crate for two-liter bottles comprising a peripheral wall including a pair of side walls and a pair of end walls; a crate bottom integrally connected to the peripheral wall; said peripheral wall having a height equal to about ⅓ the height of a two-liter bottle; an interior longitudinal partition and a plurality of transverse partitions defining eight bottle receiving pockets in two rows of four; three interior columns along the longitudinal partition, each interior column having interior surfaces facing into four surrounding bottle receiving pockets; the interior surfaces for each of the four surrounding bottle receiving pockets formed with respective first pairs of vertically oriented convex ribs.

DETAILED DESCRIPTION OF THE INVENTION

Figure 1:
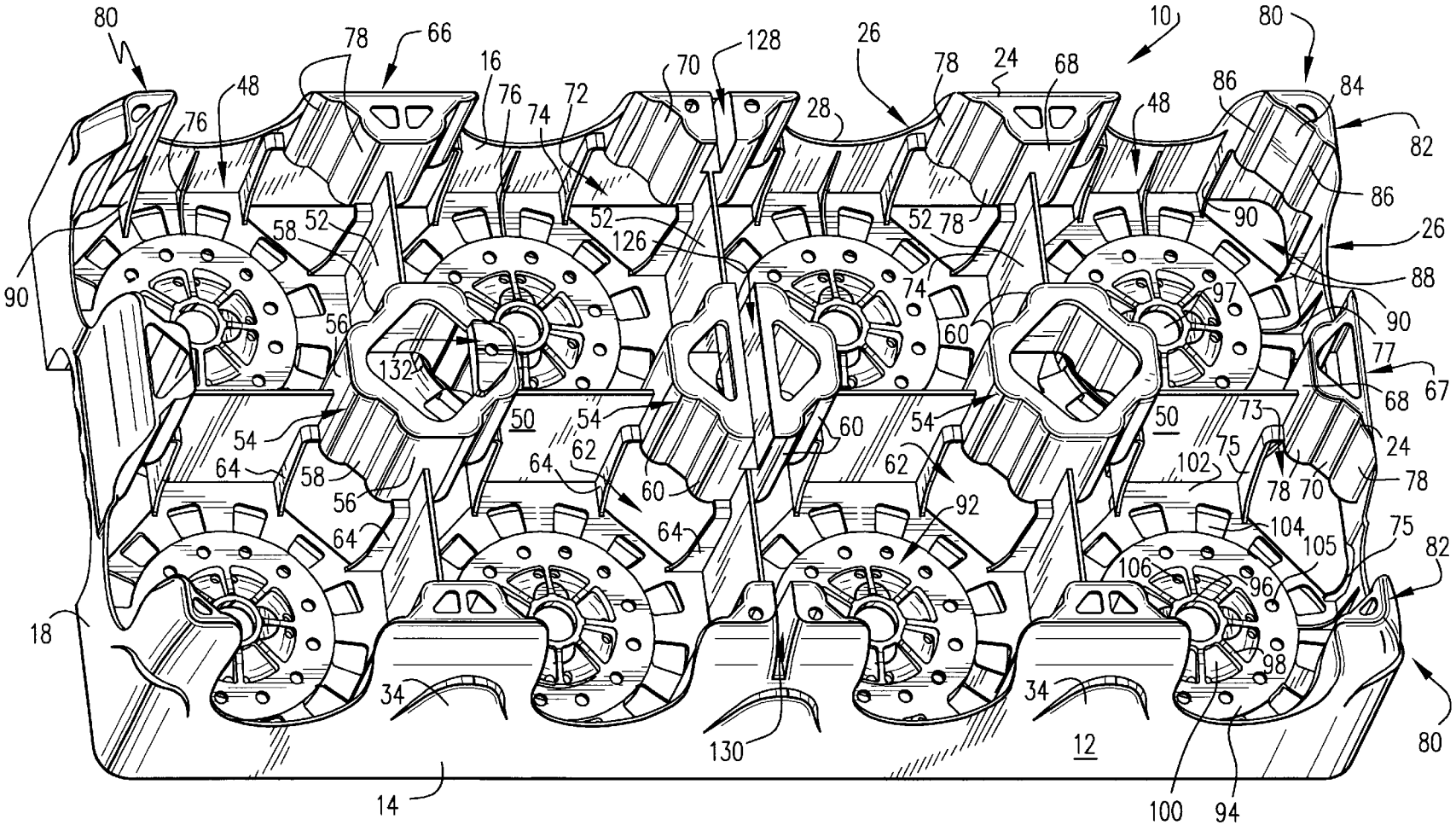
FIG. 1 is a perspective view of the two liter crate in accordance with the invention.
Figure 2:
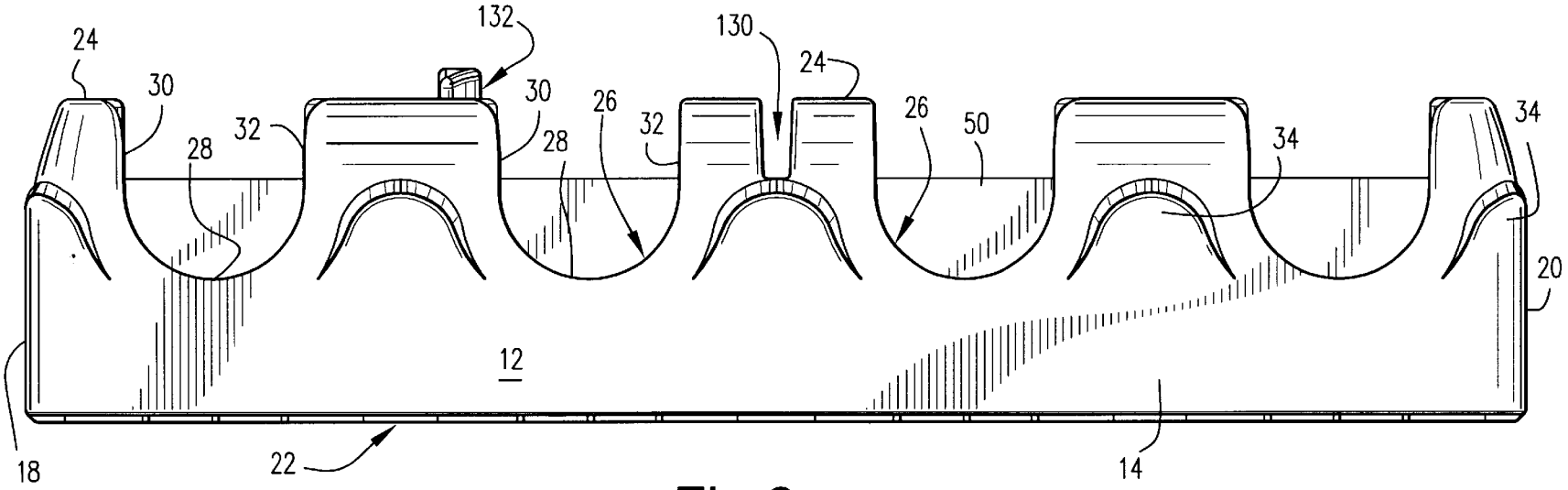
FIG. 2 is a side elevation thereof.
Figure 3:
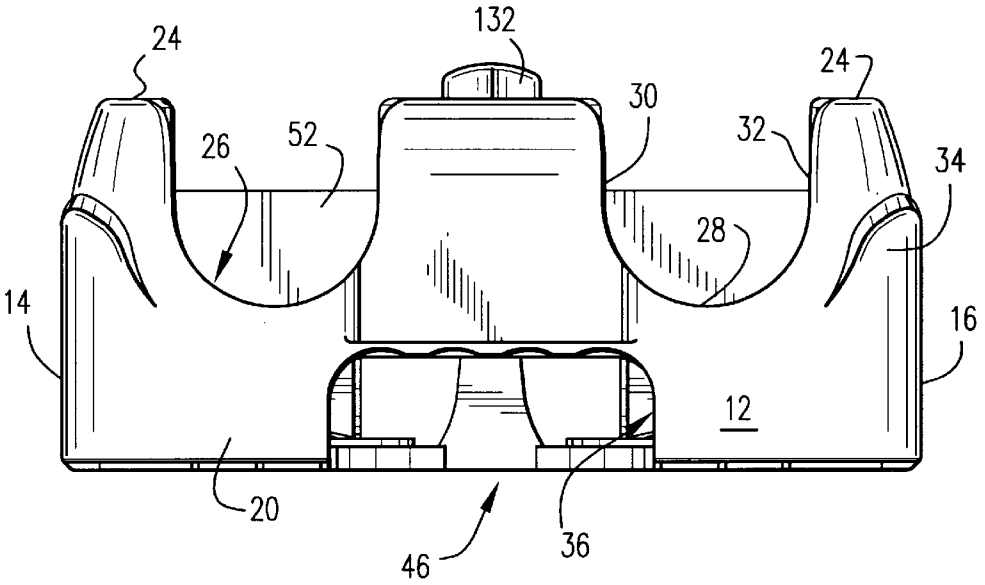
FIG. 3 is a right end elevation thereof.
Figure 4:
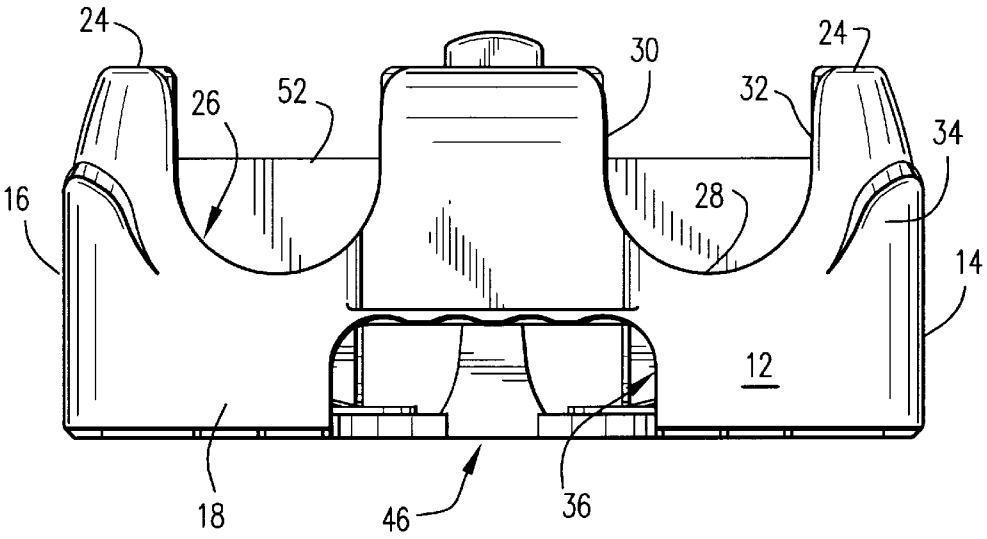
FIG. 4 is a left end elevation thereof.
Figure 5:
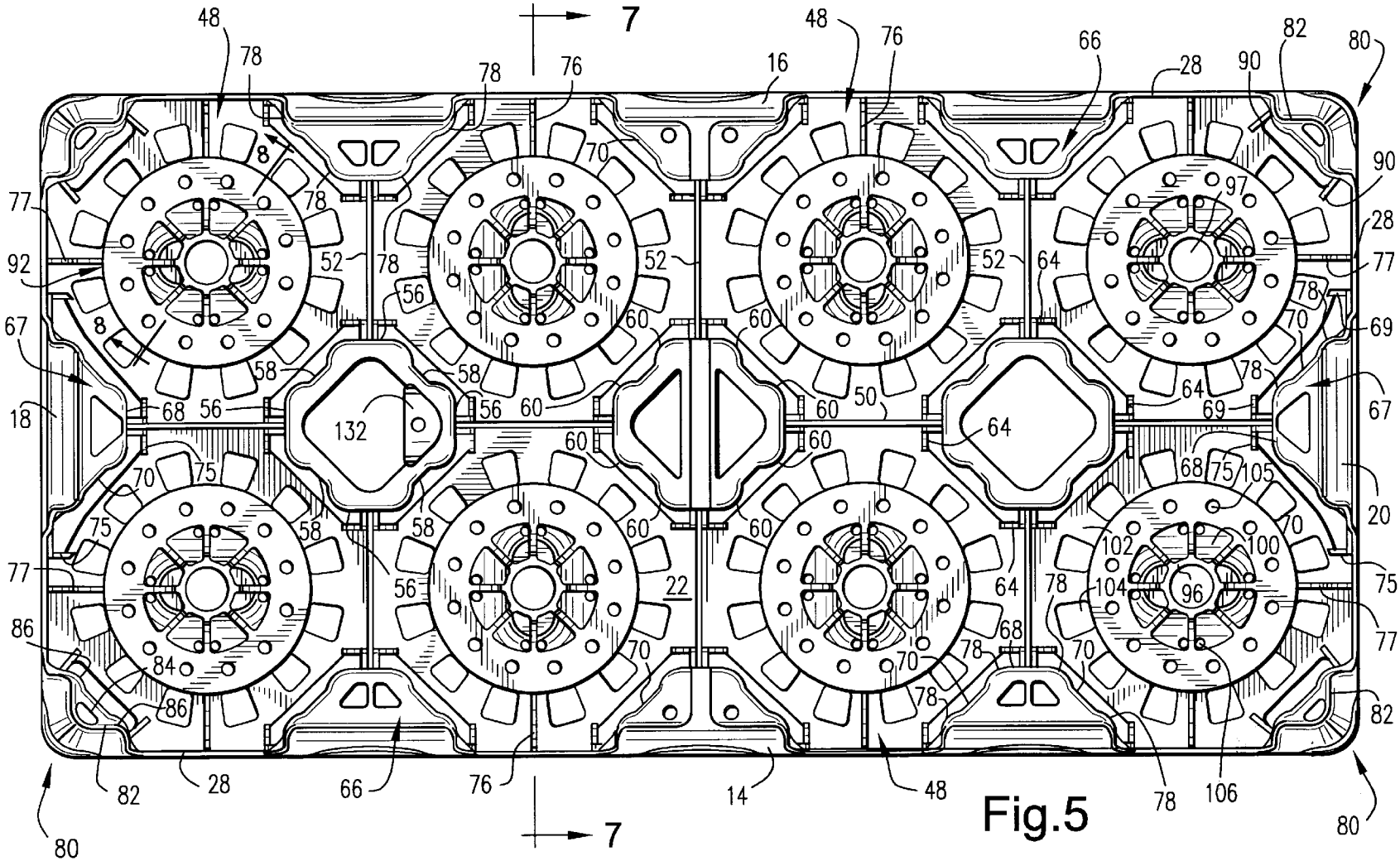
FIG. 5 is a top plan view thereof.
Figure 6:
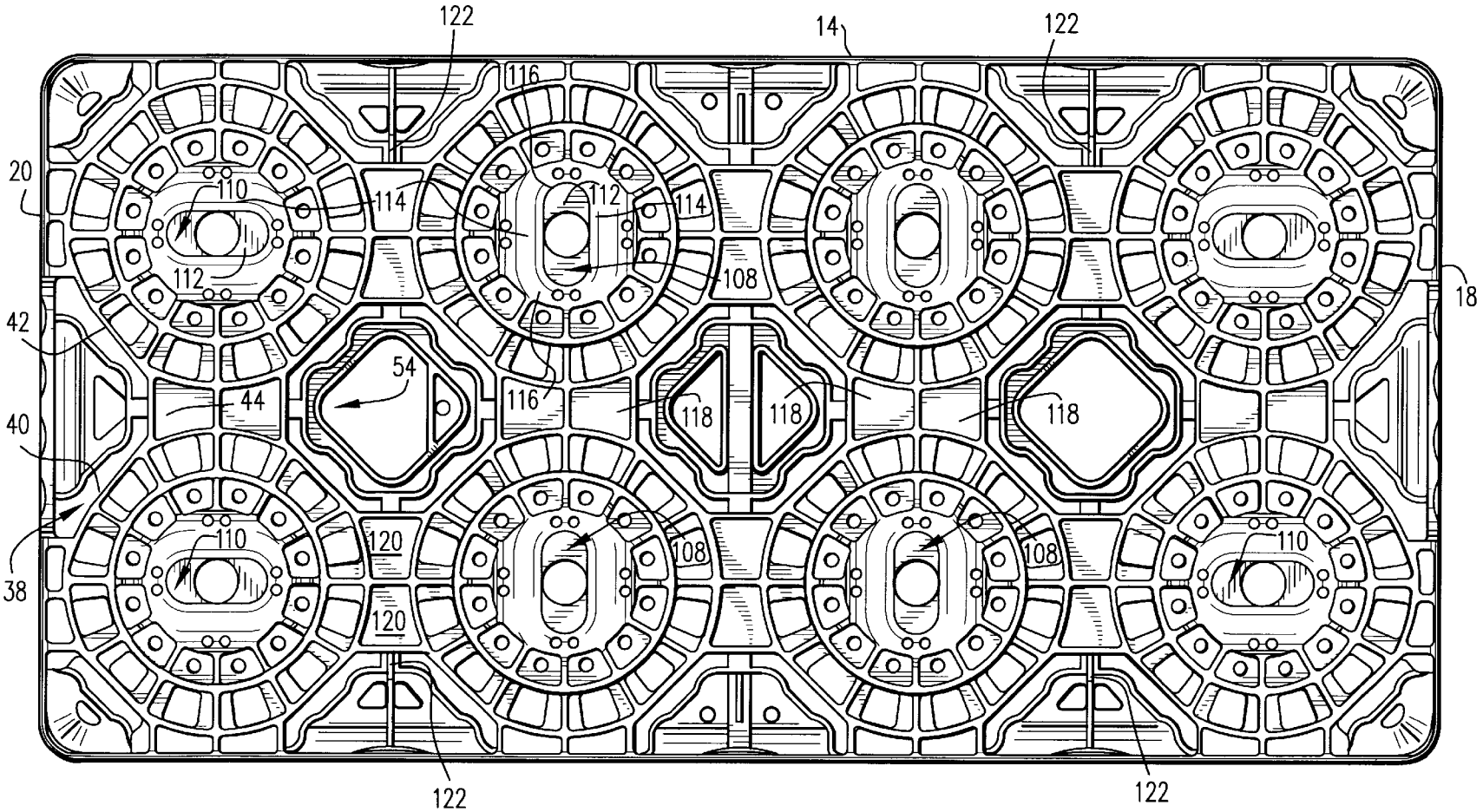
FIG. 6 is a bottom plan view thereof.

With reference initially to FIGS. 1–6, the crate 10 in one exemplary embodiment has a peripheral wall 12 that includes a pair of side walls 14, 16 and a pair of end walls 18, 20. The peripheral wall 12 is of uniform height, extending from a crate bottom 22 to an intermittent or discontinuous top surface 24. The latter is created by a series of U-shaped cut-outs 26 that are spaced about the peripheral wall, with four such cut-outs in each of the respective side walls 14, 16 and two in each of the respective end walls 18, 20. The cut-outs 26 reduce the weight of the crate and also provide good visibility with respect to labels on individual bottles in the crate. In this regard, the cut-outs are centered on individual bottle support platforms formed in the crate bottom, with two mutually perpendicular cut-outs for the support platforms in the corners of the crate. Each cut-out in the side and end walls has a smooth radiused edge 28 that merges into a pair of straight vertical edges 30, 32 that terminate at the discontinuous top surface 24 of the peripheral wall 12.

In the areas between the cut-outs 26, and just above the radiused edges 28, oppositely radiused pads 34 are integrally formed on the exterior of the side walls 14, 16 and in the four corner areas. These thickened pads provide additional surface area for handling by, for example, palletizing equipment, given that the upper portion of the peripheral wall 12 curves inwardly to permit nesting of similar crates. The pads 34 also provide good lateral support between similar crates when stacked in multiple adjacent columns.

The end walls 18, 20 each have a centrally located generally rectangular cut-out 36 in the lower portion thereof. This generally vertical cut-out 36, combined with a horizontal cut-out 38 in the crate bottom as defined by ribs 40, 42 and a web 44, create a handle opening 46 that allows a user to grasp and lift the crate at opposite ends.

The interior of the crate is divided into two rows of bottle receiving pockets 48 by a longitudinal partition 50, extending from end wall 18 to end wall 20 along the longitudinal center of the crate, and by transverse partitions 52 (see also FIG. 7) extending between the side walls 14, 16, thus establishing four bottle receiving pockets 48 in each of the two rows. It will be appreciated that, except as noted herein, the bottle receiving pockets (and various other portions of the crate) are repetitive and substantially identical, and reference numerals in the drawings have been judiciously applied with this in mind, so as not to overcrowd the various figures with numerals. The middle transverse partition 52 intersects the longitudinal partition 50 at the longitudinal and transverse center of the crate. At each of the three interior intersections of the longitudinal partition 50 with a respective transverse partition 52, a generally octagon-shaped interior column 54 is formed by four walls 56 that are perpendicular to the respective intersecting partitions 50, 52 and four walls 58 that face radially towards the center of four adjacent (i.e., surrounding) bottle receiving pockets. Each wall 58 is shaped to present a pair of spaced, vertically oriented convex ribs 60 that provide bottle supporting surfaces for the bottle in the respective pocket 48. The interior columns 54 are substantially hollow, and supported by the partitions 50, 52, and thus extend only about half way toward the crate bottom. This configuration conserves material and provides openings 62 below each column for receiving the columns in an underlying crate when a plurality of similar crates are stacked empty. The partitions 50, 52 are reinforced by respective perpendicular flanges or ribs 64 that frame the sides of each opening 62.

The interior of the side walls 14, 16 and end walls 18, 20 between the cut-outs 26, are formed with respective partial or half columns 66, 67 (approximating one half of an interior column 54) where the transverse partitions 52 intersect the side walls 14, 16, and where the longitudinal partition 50 intersects the end walls 18, 20. These side and end wall half columns 66, 67 each include walls 68 that are perpendicular to respective partitions 52, 50 and angled walls 70 that face radially toward the respective centers of two adjacent of the bottle receiving pockets 48. These half columns are supported respectively, by the partitions 52, 50 side walls 14, 16 and end walls 18, 20. The half columns 66 also extend about halfway toward the crate bottom, with openings 72 formed therein (similar to openings 62). The partitions 52 and side walls 14, 16 are reinforced by perpendicular flanges or ribs 74 that frame the sides of the openings 72. Additional reinforcing ribs or gussets 76 extend between the side walls and crate bottom, centrally between adjacent partial columns. The end wall columns 67 also extend only about halfway to the crate bottom 22, with openings 73 framed by ribs 75 joined to the longitudinal partition 50 on one side of the opening and to the respective end wall 18 or 20 on the other side of the opening. Additional reinforcing ribs or gussets 77 (similar to gussets 76) are located between the end wall half columns and the crate corners. The angled walls 70 of the side and end wall half columns 66, 67 are also each formed with a pair of spaced, vertically oriented convex ribs 78 that provide bottle supporting surfaces for the bottles in each of the two adjacent pockets.

Note that the openings 73 below the half columns 67 on the end walls 18, 20 also contribute to the space available for the user's hands in the handle openings.

The corners 80 of the crate have similar but smaller "quarter" columns 82 (approximating one quarter of an interior column 54) and include an interior surface 84 formed with a pair of vertically oriented, convex ribs 86 facing radially towards the respective centers of the corner bottle receiving pockets. The corner quarter columns 82 also have lower openings 88 framed by inwardly facing flanges or ribs 90.

Accordingly, it will be appreciated that for each bottle receiving pocket 48, a bottle loaded therein will be supported by (and can only be engaged by) four pairs of radially inwardly facing convex ribs. Because each rib provides only tangential contact with the oppositely curved peripheral bottle surface, scuffing of the bottle is minimized.

Figure 7:
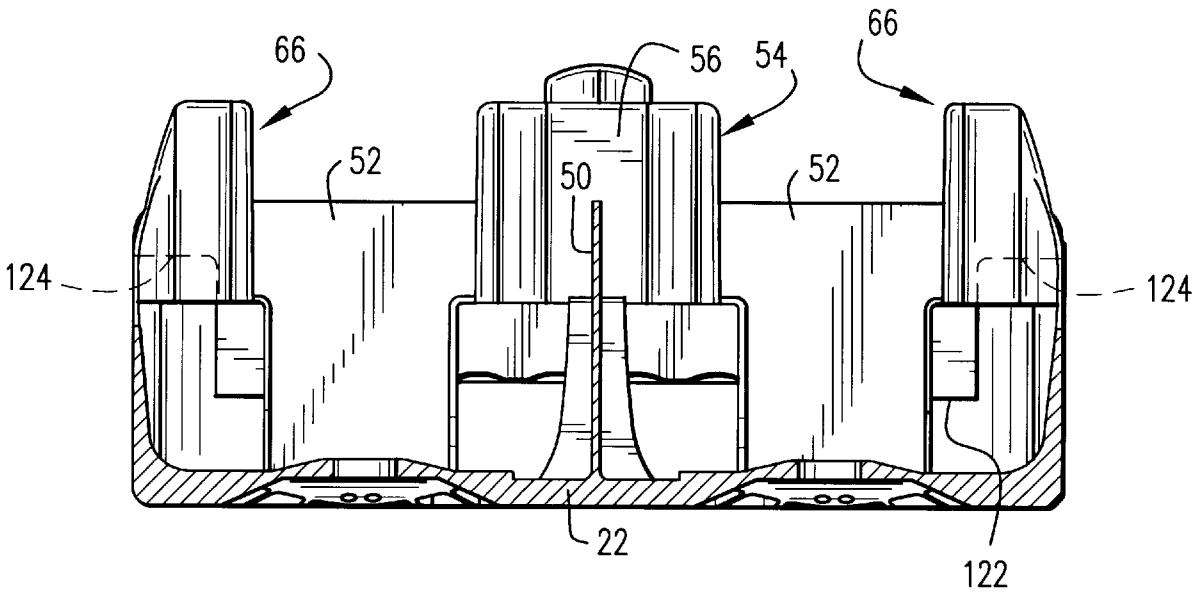
FIG. 7 is a section taken along line 6—6 in FIG. 4.
Figure 8:
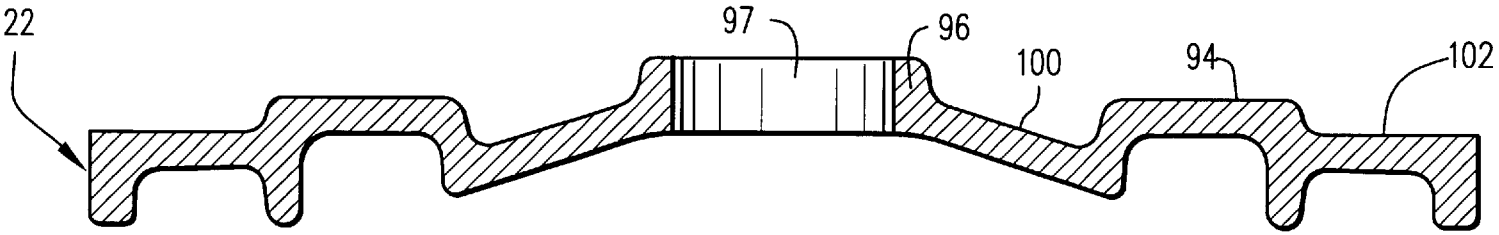
FIG. 8 is a partial cross-section showing the profile of a bottle supporting platform in accordance with the invention.

The crate bottom 22 is a grid-like structure integrally connected to the lower edge of the crate peripheral wall 12. The interface between the crate bottom and the peripheral 12 is strengthened not only by the above described ribs 74 and 90 but also by the additional ribs or gussets 76, 77 that are substantially centered on the peripheral wall cut-outs 26. Within each bottle receiving pocket 48, the crate bottom is formed to include a corresponding 2-liter bottle supporting platform 92, designed particularly for bottles with petaloid bottoms. With reference also to FIGS. 7 and 8, intermediate annular ring 94 is engaged by and supports the individual petaloid base of the bottle, while a raised center ring 96 (defining an aperture 97 concentric with a vertical center axis of the platforms 92 and pocket 48) projects into the recessed center of the petaloid base. Tapered radial ribs 98 extend between the center ring 96 and the intermediate ring 94, with tapered webs 100, therebetween. An outer annular ring 102, with radial openings 104, extends between the intermediate annular ring 94 and the longitudinal and transverse partitions 50, 52. This outer annular ring 102 is recessed relative to the intermediate annular ring 94 and is not engaged by a bottle seated in the pocket. Within the intermediate ring 94 and tapered webs 100, drainage holes (such as those indicated at 105, 106) are provided to preclude fluid retention within the pockets.

Figure 10:
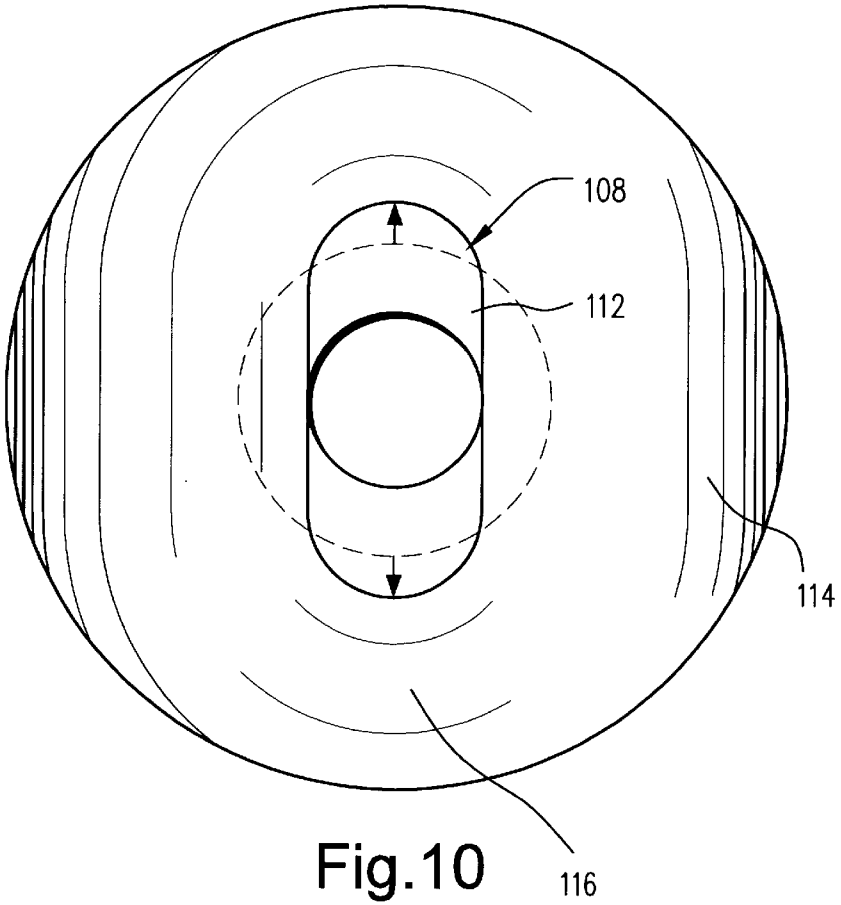
FIG. 10 is an enlarged detail similar to FIG. 8, illustrating how a closure interacts with other recesses in the crate bottom.
Figure 9:
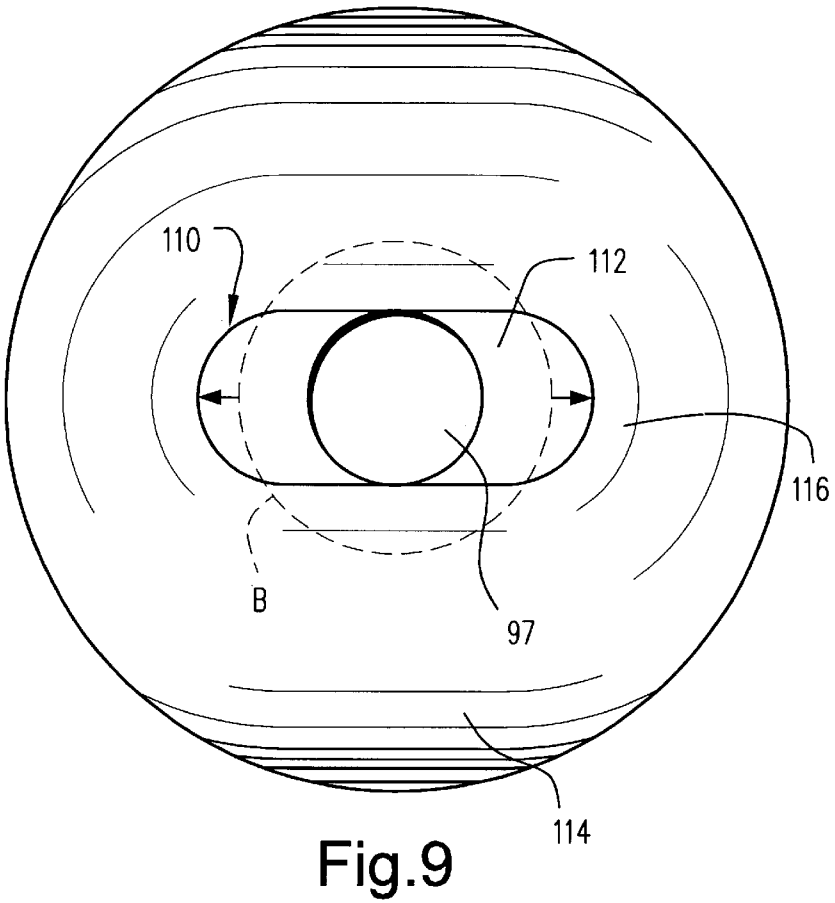
FIG. 9 is an enlarged and simplified detail illustrating how a bottle closure interacts with certain recesses in the crate bottom.

The under surface of the crate bottom substantially mirrors the upper surface. Note that the tapered webs 100 between the radial ribs on the upper surface are shaped to form elongated recesses 108, 110 on the lower surface of the crate bottom, centered on the vertical axis of the respective platform. With reference also to FIGS. 8 and 9, note that the recesses 108 in the platforms of the four pockets surrounding the interior column 54 in the crate center extend transversely of the crate side walls, while the recesses 110 in the platforms of the two pockets at the opposite ends of the crate extend parallel to the crate side walls. Each recess 108, 110 has a flat bottom 112 defined by parallel sides and radiused ends, surrounded by downwardly and outwardly tapered surfaces 114, 116. Each recess has a length dimension larger than the diameter of a bottle closure B (in phantom in FIGS. 9 and 10) that will engage the recess when loaded crates are stacked one on top of the other, and a width dimension substantially smaller than the closure diameter. In the preferred arrangement, the length of the recess is about twice the width. As a result, as best seen in FIGS. 9 and 10, the closure will engage the opposed tapered surfaces 114 (underside of webs 100) across the width of the recess, but, if centered relative to the platform, will not engage the tapered surfaces 116 across the length of the recess. Movement of the closure along the length dimension into engagement with one tapered surface 116 at the end of the recess will increase the spacing between the closure and the tapered surface at the opposite end of the recess, and vice versa. Thus, a bottle closure is free to move small distances along the tapered surfaces 114 across the width of the recess, between limits imposed by the tapered surfaces 116 across the length of the recess. In light of the mutually perpendicular orientation of the recesses 108, 110 at the crate ends and the crate center, the combined effect will be to approximately center the bottle closures relative to the bottle supporting platforms 92, i.e., on the apertures defined by center rings 96 described above.

Reinforced webs 118 between adjacent lengthwise platforms provide bases or supports for the longitudinal partition 50, while reinforced webs 120 between adjacent widthwise platforms provide bases or supports for the transverse partitions 52.

The transverse partitions 52 on either side of the center transverse partition, are stepped within the partial columns 66 at 122 and 124. As best seen in FIG. 7, the edge or rib 122 thus provides a stop for an underlying nested crate. In other words, the upper crate is supported on the lower crate by reason of ribs 120 of the upper crate resting on the upper surfaces of the side wall half columns of the lower crate. Thus, when empty crates are nested, there is no engagement with the exterior peripheral wall surface of an underlying crate, but it is the inward taper of the peripheral wall that permits the nesting of empty crates.

Referring back to FIGS. 1 and 2, a transverse slot is formed across the center of the crate, and is made up of slot segments including segment 126 through the center one of interior columns 54 and adjacent and aligned segments 128, 130 in the adjacent side wall half columns 66. This slot allows crosswise stacking of empty crates, i.e., the slots 126, 128 and 130 receive a side wall of an overlying crosswise stacked crate.

An optional tab 132, projecting upwardly from one column adjacent the center column along the longitudinal partition 50, serves as a destabilizing device in the event the crate is inverted and attempted to be used as a stepping stool or the like. The tab 132 otherwise serves no bottle support function.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A low depth bottle crate having a peripheral wall of uniform height, said peripheral wall including a pair of side walls and a pair of end walls; a longitudinal interior partition extending between said end walls and a plurality of transverse interior partitions extending between said side walls to thereby create a plurality of bottle receiving pockets within said peripheral wall; a crate bottom connected to said peripheral wall, an upper surface of said crate bottom formed to include a bottle supporting platform for each bottle receiving pocket; a plurality of interior columns located at intersections of said transverse partitions and said longitudinal partition, each said interior column having an interior surface facing radially into each of four of said bottle receiving pockets that surround each of said interior columns, each surface having a pair of vertically extending interior convex ribs adapted to provide support for a bottle loaded into the respective pocket.

2. The crate of claim 1 further comprising a plurality of side wall half columns located along said side walls at intersections of said transverse partitions and said side walls, each side wall half column having an interior angled surface facing radially into each of two of said bottle receiving pockets adjacent each half column, each interior angled surface having a pair of vertically extending convex ribs adapted to provide support for the bottle loaded into the respective pocket.

3. The crate of claim 2 wherein each corner of the crate is formed with a quarter column, each having a corner surface facing radially into one adjacent bottle receiving pocket, the corner surface having a pair of vertically extending convex ribs adapted to provide support for the bottle loaded into the pocket.

4. The crate of claim 3 and further comprising an end wall half column centrally located on each of said end walls, said half column having a pair of end surfaces facing radially into two adjacent pockets, each end surface formed with a pair of vertically extending convex ribs adapted to provide support for the bottle.

5. The crate of claim 3 wherein none of said quarter columns extend above said peripheral wall.

6. The crate of claim 2 wherein said plurality of side wall half columns are separated by substantially U-shaped cut-outs.

7. The crate of claim 6 wherein neither of said end wall half columns extend above said peripheral wall.

8. The crate of claim 6 wherein said end walls each have an elongated cut-out area below a respective end wall half column to thereby provide a handle for lifting the crate.

9. The crate of claim 8 wherein each said end wall half column is connected to said crate bottom by means of said longitudinal partition.

10. The crate of claim 1 wherein one of said interior columns is formed with a projection extending above said peripheral wall, said projection located such that it provides no support for any bottle loaded into said crate, said projection adapted to provide a degree of instability to said crate when in an inverted orientation.

11. The crate of claim 10 wherein, except for said projection, none of said interior columns extend above said peripheral wall.

12. The crate of claim 2 wherein none of said side wall half columns extend above said peripheral wall.

13. The crate of claim 1 and further comprising aligned transverse slots through a pair of said side wall half columns and an interior column to thereby enable cross-stacking of similar crates.

14. The crate of claim 1 wherein each bottle support platform includes an outer ring, an intermediate bottle support ring, and an inner ring raised relative to said outer ring.

15. The crate of claim 14 wherein said intermediate ring is raised relative to said outer ring.

16. The crate of claim 14 wherein each of said bottle support platforms has an aperture centered on a vertical center axis of the platform, said inner ring defining said aperture.

17. The crate of claim 1 wherein each platform includes an aperture centered on a vertical axis of the platform.

18. The crate of claim 17 wherein each platform has a lower surface formed with an elongated recess extending across said vertical axis, said recess having a flat base with a width substantially equal to a diameter of said aperture.

19. The crate of claim 18 wherein said flat base is surrounded by a tapered surface extending downwardly and outwardly away from said flat base.

20. The crate of claim 19 wherein said recess has a length dimension about twice said width.

21. The crate of claim 20 wherein said width is less than a diameter of a bottle closure received in the recess when a plurality of similar loaded crates are stacked.

22. The crate of claim 21 wherein said length is greater than the diameter of the bottle closure.

23. The crate of claim 18 wherein some of said elongated recess extend parallel to said side walls and some of said elongated recesses extend parallel to said end walls.

24. The crate of claim 23 wherein said recesses extending parallel to said side walls are located in each of two adjacent bottle receiving pockets at opposite ends of the crate.

25. The crate of claim 23 wherein said recesses extending parallel to said end walls are located in each of four bottle receiving pockets surrounding a center one of said interior columns.

26. The crate of claim 24 wherein said recesses extending parallel to said end walls are located in each of four bottle receiving pockets surrounding a center one of said interior columns.

27. The crate of claim 1 wherein some of said transverse partitions have a nesting stop edge within respective side wall half columns that engage top surfaces of a similar underlying crate when nested empty.

28. A bottle crate having a peripheral wall including a pair of side walls and a pair of end walls; a crate bottom integrally connected to said peripheral wall, an upper surface of said crate bottom formed to include a plurality of bottle supporting platforms, each platform having an aperture centered on a vertical center axis of the platform; each platform having a lower surface formed with an elongated recess extending across said vertical axis, said elongated recess having a flat base surrounded by a tapered surface.

29. The crate of claim 28 wherein said tapered surface extending downwardly and outwardly away from said flat base.

30. The crate of claim 29 wherein said recess has a length dimension about twice said width dimension.

31. The crate of claim 30 wherein said width is less than a diameter of a bottle closure received in the recess when a plurality of similar loaded crates are stacked.

32. The crate of claim 31 wherein said length is greater than the diameter of the bottle closure.

33. The crate of claim 28 wherein some of said elongated recesses extend parallel to said side walls and some of said elongated recesses extend parallel to said end walls.

34. The crate of claim 33 wherein said recesses extending parallel to said side walls are located in each of two adjacent bottle receiving pockets at opposite ends of the crate.

35. The crate of claim 34 wherein said recesses extending parallel to said end walls are located in each of four bottle receiving pockets surrounding a center one of said interior columns.

36. The crate of claim 33 wherein said recesses extending parallel to said end walls are located in each of four bottle receiving pockets surrounding a center one of said interior columns.

37. A bottle crate having a peripheral wall including a pair of side walls and a pair of end walls; a crate bottom integrally connected to said peripheral wall, an upper surface of said crate bottom formed to include a plurality of bottle supporting platforms, each platform having a vertical center axis; each platform having a lower surface formed with an elongated recess extending across said vertical axis; wherein some of said recesses extend parallel to said side walls and some of said recesses extend parallel to said end walls.

38. The crate of claim 37 wherein said recesses extending parallel to said side walls are located in each of two adjacent bottle receiving pockets at opposite ends of the crate.

39. The crate of claim 37 wherein said recesses extending parallel to said end walls are located in each of four bottle receiving pockets surrounding a center one of said interior columns.

40. The crate of claim 38 wherein said recesses extending parallel to said end walls are located in each of four bottle receiving pockets surrounding a center one of said interior columns.

41. The crate of claim 37 wherein each elongated recess has a flat base surrounded by a tapered surface extending downwardly and outwardly away from said flat base.

42. The crate of claim 41 wherein said recess has a length dimension about twice said width dimension.

43. The crate of claim 42 wherein said width is less than a diameter of a bottle closure received in the recess when a plurality of similar loaded crates are stacked.

44. The crate of claim 43 wherein said length is greater than the diameter of the bottle closure.

45. A low depth crate for two-liter bottles comprising a peripheral wall including a pair of side walls and a pair of end walls; a crate bottom integrally connected to said peripheral wall; said peripheral wall having a height equal to about ⅓ the height of a two-liter bottle; an interior longitudinal partition and a plurality of transverse partitions defining eight bottle receiving pockets in two rows of four; three interior columns along said longitudinal partition, each interior column having interior surfaces facing into four surrounding bottle receiving pockets; said interior surfaces for each of said four surrounding bottle receiving pockets formed with respective first pairs of vertically oriented convex ribs.

46. The crate of claim 45 and further comprising side wall half columns along said side walls, each side wall half column centered on a respective one of said plurality of transverse partitions and extending no higher than said peripheral wall; said side wall half columns having side surfaces facing radially into two adjacent bottle receiving pockets; said side surfaces for each of said two adjacent bottle receiving pockets formed with respective second pairs of vertically oriented convex ribs.

47. The crate of claim 46 and further comprising a quarter column in each corner of the crate, each quarter column having a corner surface facing radially into an adjacent bottle receiving pocket, said corner surface formed with respective third pairs of vertically oriented convex ribs.

48. The crate of claim 47 and further comprising an end wall half column centrally located on each of said end walls, said half column having end surfaces facing radially into two adjacent bottle receiving pockets, said end surfaces formed with respective fourth pairs of vertically extending convex ribs.

49. The crate of claim 48 wherein none of said interior columns extend above said peripheral wall.

50. The crate of claim 46 wherein none of said side wall half columns, end wall half columns or corner columns extend above said peripheral wall.

51. The crate of claim 46 wherein one of said interior columns is formed with a projection extending above said peripheral wall, said projection located such that it provides no support for any bottle loaded into said crate, said projection adapted to provide a degree of instability to said crate when in an inverted orientation.

52. The crate of claim 45 wherein said side walls and end walls are formed with spaced, radiused cut-outs.

53. The crate of claim 45 and further comprising aligned transverse clots through a pair of said side wall half columns and an interior column to thereby enable cross-stacking of similar crates.

* * * * *